United States Patent [19]

Christensen

[11] Patent Number: 4,901,606

[45] Date of Patent: Feb. 20, 1990

[54] APPARATUS FOR INSERTING AND EXTRACTING LIGHT BULBS

[76] Inventor: Marc F. Christensen, R.R. #5, Box 178, Covington, La. 70433

[21] Appl. No.: 208,722

[22] Filed: Jun. 20, 1988

[51] Int. Cl.[4] ..... B25B 21/00

[52] U.S. Cl. ..... 81/57.11; 81/57.31; 81/53.12; 294/64.1

[58] Field of Search ..... 81/53.1, 53.11, 53.12, 81/57.12, 57.14, 57.13, 57.11, 57.28, 57.29, 57.3, 57.31; 294/64.1

[56] References Cited

U.S. PATENT DOCUMENTS 558,573 4/1896 Smith ..... 815/3.12

2,558,479 6/1951 Miller ..... 294/64.1 X 2,573,002 10/1951 Foster ..... 294/64.1 X

*Primary Examiner*—D. S. Meislin

*Attorney, Agent, or Firm*—Keaty & Keaty

[57] ABSTRACT

The invention relates to a device for positioning or extracting light bulbs from hard-to-reach places. The device has an extendable handle, and support attached to the handle and the main housing mounted on the support for a limited rotational movement about longitudinal axis of the support. A pair of independently activated electrical motors positioned within the housing operate the device. The first motor transmits a longitudinal movement to a piston having a suction cup for gripping a light bulb, and a second motor transmits rotational movement to the gripped bulb.

14 Claims, 3 Drawing Sheets

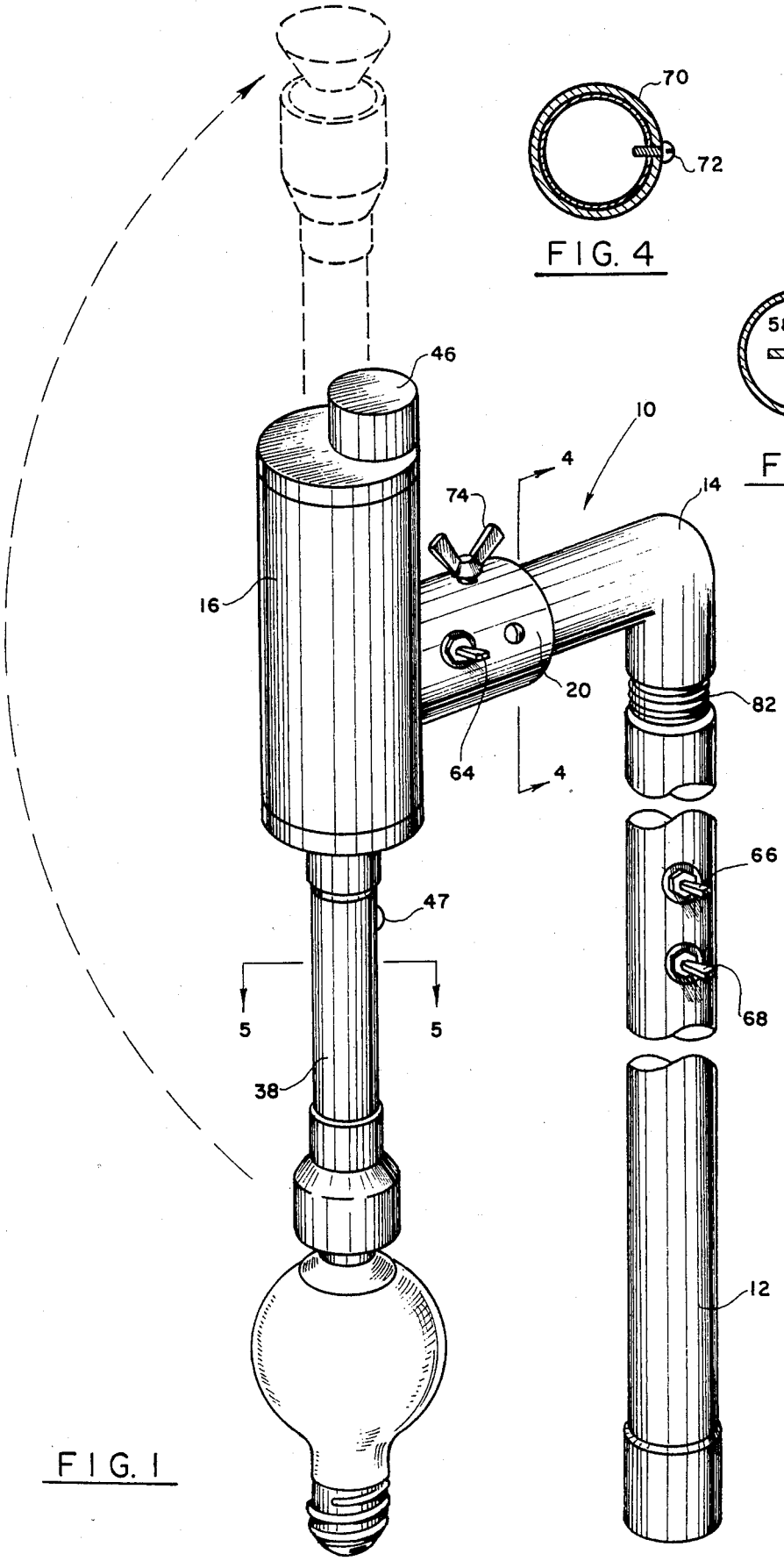
FIG. 1
FIG. 4
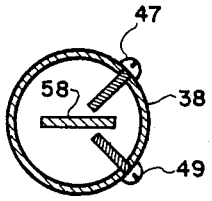
FIG. 5

APPARATUS FOR INSERTING AND EXTRACTING LIGHT BULBS

BACKGROUND OF THE INVENTION

The present invention relates to an apparatus for inserting and positioning of light bulbs, and more specifically to an apparatus for positioning or removing of light bulbs from sockets in hard-to-reach places, such as at high locations, angular positions and the like.

There are known devices which are designed for positioning or extracting light bulbs from their sockets. Many of these devices use a suction cup which creates a vacuum between the surface of the light bulb and interior of the suction cup, thus allowing a secure engagement of the light bulb by the suction cup. These devices are mainly hand operated and some of them are rather complex, requiring a lot of manipulation to be performed for transmitting a rotational movement from the handle of the tool to the bulb when torque needs to be applied to the bulb for extracting or positioning of it in the socket.

Additionally, many of these devices are bulky, requiring a lot of moving parts for performing the desired task.

Some of the known patents directed towards the task of positioning and extracting a light bulb include U.S. Pat. No. 2,924,481 issued on Feb. 9, 1960, U.S. Pat. No. 2,983,541 issued on May 9, 1961, U.S. Pat. No. 4,218,085 issued on Aug. 19, 1980 and U.S. Pat. No. 1,619,559 issued on Mar. 1, 1927.

The present invention is directed towards elimination of shortcomings from which some of the known devices suffer and provision of an easy to operate, inexpensive apparatus for positioning or extracting of a light bulb from its socket.

SUMMARY OF THE INVENTION

The present invention solves the shortcomings of the prior art and achieves its objectives in a simple and straightforward manner. The apparatus comprises a handle portion, a support perpendicularly attached to the handle portion and a main housing which is mounted on the support portion and adapted for a limited rotational movement about a longitudinal axis of the support portion. The main housing houses a pair of independently activated electrical motors, one of which is designed for transmitting a longitudinal axial movement on a piston, which forms a part of the gripping means for a light bulb, with a second motor being designed for transmitting rotational movement to the gripping means through the piston. To facilitate axial, longitudinal movement of the piston within a piston housing, the first motor has an output shaft attached to a threaded screw, which passes through an internally threaded nut, which, in turn, is fixedly attached to the second motor, thus transmitting a limited longitudinal movement on the second motor, through movement of the nut along the screw. The output shaft of the second motor is attached to a piston, while the second end of the piston has a piston head frictionally engaging the interior wall of the piston housing. Thus, when activated, the second motor transmits a rotational movement to the piston, as well as the piston housing, allowing transmittal of rotational movement to a light bulb which has been gripped by the gripping means during axial movement of the second motor and of the piston head associated with the piston. The partial vacuum which is created between a gripping cup and interior of the piston housing allows retaining of the light bulb by the gripping means during the entire operation. Two motors are activated by a DC power source, in the form of a battery which is mounted in the handle. Extension of the handle is permitted through disassembling of the handle into two parts and incorporating a new desired length of the handle segment to the divided parts by conventional threaded connections. A number of switches allows activation of a first or a second motor independently from each other. Rotation of a piston housing is accomplished independently from a main housing in which the motors are positioned. The apparatus of the present invention provides a number of advantages, among which is creation of a strong securing force for gripping of a light bulb, ease of manipulation with different size bulbs and bulbs positioned at an angle; provision of easy access and gripping of bulbs which are partially enclosed by a cover, so that only a top portion of the bulb is accessible. Other advantages and features of the present invention will be readily apparent from the foregoing detailed discussion of the present invention.

BRIEF DESCRIPTION OF THE DRAWINGS

FIG. 1 is a perspective view of the apparatus of the present invention shown with a suction cup engaging a light bulb.

FIG. 4 is a cross-sectional view taken along lines 4—4 of FIG. 1.

FIG. 5 is a cross-sectional view taken along lines 5—5 of FIG. 1.

DETAILED DESCRIPTION OF THE PREFERRED EMBODIMENT

Figure 2:
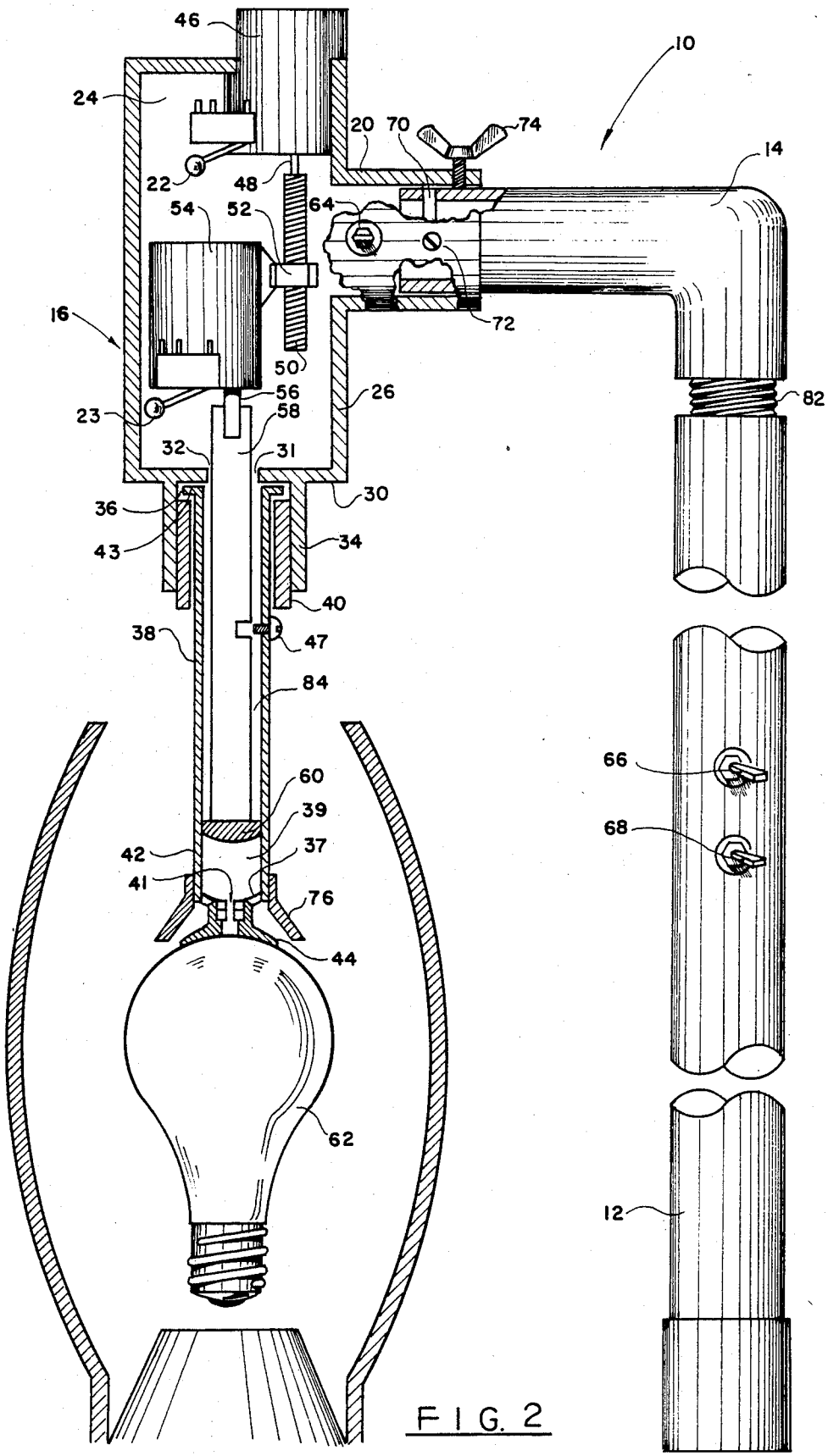
FIG. 2 is a sectional, partially cutaway view of the apparatus of the present invention.

Reference will now be made to the drawings, and specifically to FIGS. 1, 2, 4 and 5 illustrating the apparatus of the present invention.

As can be seen in the drawings, the apparatus of the present invention, designated by numeral 10 in the drawings, comprises an elongated handle 12 which is detachably connected to a support 14. The handle 12 and the support 14 are tubular in cross-section, although any other configuration can be employed for this purpose.

The support 14 has a longitudinal axis which is perpendicular to a longitudinal axis of the handle 12. Rotatably attached to the support 14 is a housing 16, which has a hollow interior and designed for accommodating a number of operational elements of the apparatus of the present invention. The housing 16 is secured to the support 14 at its middle portion in such a manner that a longitudinal axis of the housing 16 is substantially perpendicular to the longitudinal axis of the support 14 and substantially parallel to the longitudinal axis of the handle 12. The housing 16 has a flange 20 extending outwardly from its middle portion which is adapted for frictional engagement on the exterior of one end of the support 14.

The housing 16 has ends 24 and 26 (FIG. 2). The end 26 has an annular wall 30, extending inwardly from the outermost ends of the housing 16, and defining in the center of it a passage 32 protected by cylindrical extension 34 extending downwardly from the wall 30, perpendicularly therefrom and a distance from innermost end 31 of the wall 30. A flange 36 is thereby formed between the inner wall of the extension 34 and the end 31 of the wall 30.

Resting against the flange 36, at its one end, is a cylindrical piston housing 38, which has a hollow cylindrical interior. An insert 40 is conveniently positioned between the innermost wall of the extension 34 and the outermost wall of the piston housing 38, and has a length at least as great as the length of the extension 34, following the circular shape of the cylindrical housing 38. Insert 40 firmly engages the inner walls of extension 34.

The upper end of the housing 38 has an opening which is slightly less than the opening 32 of the housing 16.

The piston 58, along with the piston head 60 is adapted for a limited axial movement within the confines of the housing 16 and piston housing 38. A partial vacuum is created between bulb 62 and piston head 60, between the wall 42 and chamber 39. The piston housing 38 is adapted for rotation within interior of the extension 34 of the housing 16. An annular flange 43 formed on the innermost end of the housing 38 extends perpendicularly from its innermost end, the flange having a length substantially equal to or less than the width of the insert 40, so that the insert rests, at one of its ends, against the shoulder formed by the flange 43, thus preventing disengagement of the piston housing 38 from its relative engagement with the extension 34 of the main housing 16.

The opposite end of the piston housing 38 has a circular wall 42 with a central opening 41 allowing communication between the outside of the piston housing 38 and a lower end 37 of the interior of the housing 38, with its inner chamber 39. Mounted on the wall 42, and fixedly attached thereto, is a suction cup 44 which has a central opening substantially equal in diameter to the opening 41.

Mounted within the housing 16, adjacent to its upper portion 24 is an electrical motor means 46, which is a miniature reversible gear reducing electrical motor, which has an output shaft 48 receiving a torque action from the motor 46 during operation. Fixedly attached to the shaft 48 is a threaded screw 50 which extends in axial alignment with the shaft 48 and passes through a connecting means 52. The connecting means 52 is adapted for a limited vertical movement in response to rotation of shaft 48. The connecting means 52 can be a nut with internal threads matching the threads of the screw 50.

The connecting means 52 is fixedly attached to a second motor means 54 which is a miniature reversible gear reducing electrical motor having an output shaft 56. The motor 54 can axially move within the housing 16. A movement limitation switch, such as a trip switch 22, can be connected to the motor 46 to limit the movement of the motor 54 towards the motor 46. A similar movement limitation means, such as trip switch 23, can be connected to the motor 54 in order to limit its outward movement away from the motor 46. The second end of the shaft 56 is fixedly attached to a piston means 58 having a piston head 60 on the outermost end thereof. The diameter of the piston head 60 is substantially equal to the diameter of the chamber 39, so that piston 60 frictionally engages the interior walls of the piston housing 38 during its longitudinal movement within the interior chamber of the housing 38 and creates an air-tight seal between the piston head 60 and the interior wall of the housing 38 at its lower end 37.

In order to limit rotation of the piston 58 within the chamber 39, a pair of limitation elements 47 and 49 are incorporated, the elements (which can be screws) passing through the wall of the piston housing 38 and contactingly engaging the piston 58 on opposite ends thereof, piston 58 having a substantially flat rectangular configuration (see FIG. 5).

Axial movement of the piston 58 and, thereby piston head 60 is accomplished through activation of motor means 46 which, through transmitting torque to the screw 50, transmits the sliding movement through rigidly attached shaft 56 to the piston 58. The activation of the motor 46 is by a switch means 64 and 66, which extend outwardly from the flange 20 and the handle 12, respectively. The switch means 64 and 66 allow such signals as "forward", "reverse" and "off" to be sent to the motor 46. An inward movement of the motor 54 (towards the motor 46) is limited by a movement limitation switch 22 and its outward movement is limited by a movement limitation switch 23, as was described hereinabove. In this manner, the axial movement of the piston 58 is controlled and limited to a desired distance within the piston housing 38.

When the piston 58 moves away from the bulb 62, the partial vacuum created between the wall 42 and the piston head 60 assures a firm grip of the suction cup 44 on the bulb 62.

When the piston 58 is moved towards the bulb 62, the vacuum is released and the light bulb 62 is easily detached. The chamber 39 is then totally incorporated into the interior chamber 84 of the piston housing 38.

The motor means 54 introduces rotational movement to the piston 58 and through screws 47 or 49 to the piston chamber 38, so that the light bulb 62 can be positioned or withdrawn from a socket as desired. A conventional switch means 68 is provided for controlling the activation of the motor means 54, allowing the above described securing or withdrawing of the light bulb 62 from its socket.

In order to withdraw the bulb from angular positions or from hard-to-reach positions, the housing 16 is adapted for a 180° rotation about a longitudinal axis of the support 14. To allow this rotational movement, a semi-circular groove 70 is formed in the wall of the support 14. A rotation limiting means in the form of a screw 72 is engaged within the groove 70, so as to limit rotation of the housing 16 about the axis of the support 14. This arrangement is further illustrated in FIG. 4.

To insure a fixed angular position of the housing 16 in relation to the support 14, a winged screw 74 is employed, the winged screw passing throgh the wall of the flange 20, frictionally contacting exterior surface of the support 14. The rotational movement of the housing 16 can be easily controlled by tightening or releasing of the screw 74.

Shown in phantom line of FIG. 1, is an alternative position of the housing 38, wherein the suction cup 44 is pivoted at an angle to support 14 for positioning of the light bulb 62 at angled locations. The L-shaped design of connection between the handle 12 and the support 14 provides for ease of manipulation of the device 10, when in use.

In some cases, the light bulb is relatively big and to insure a proper support of the light bulb by the suction cup 44, a support means 76 is provided adjacent the lowermost end of the piston housing 38, adjacent the suction cup 44. The support means 76 has a cylindrical portion 78 and an outwardly flaring, frustoconically shaped portion 80, which flares a distance from the suction cup 44 and contacts large or heavy bulbs for added stability. The portion 80 has an open base with a diameter greater than a diameter of the suction cup 44.

A power source in the form of DC power source, such as, for example, conventional batteries, is housed within the handle 12, with the connecting wires passing through the handle 12 into the support 14 and to the motor means 46 and 54, as well as their respective switches. The handle 12 can be detached from the support 14 by applying torque to the handle 12, so as to release the handle 12 from the exteriorly threaded portion 82 of the handle 12 adjacent support 14. The portion 82 is fixedly attached to the support 14. The end of the handle 12 engaging the threads 82 is conveniently provided with matching female threads on the interior of the handle 12 (not shown).

The electrical power source can be disconnected from the wiring in the support 14 through the use of conventional connection means positioned in the handle 12 (not shown).

In this manner, should the handle 12 need to be extended by adding additional segments to its length, the connection means can be disconnected and an extension segment engaged with the threads 82 with suitable connections to the rest of the handle 12, which contains the batteries providing the power source for the motor means 46 and 54.

The suction cup of the present application is preferably made from a flexible, yet sufficiently rigid material to retain its shape under the force of created vacuum. The body of housing 16, support 14 and handle 12, as well as the piston housing 38 can be made of lightweight, rigid plastic material, so as to provide suitable housing for the mechanical and electrical elements of the apparatus 10.

Figure 3:
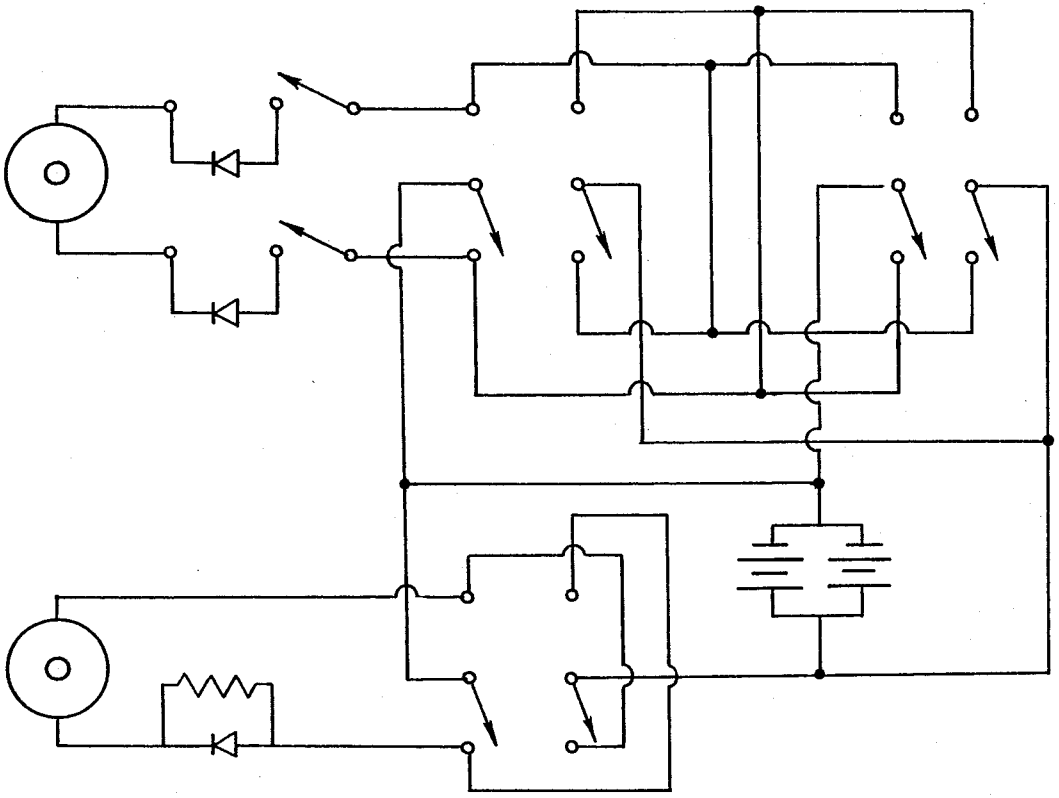
FIG. 3 is a block diagram of the electrical circuit employed in the preferred embodiment of the present invention.

The control switches 64, 66 and 68 can be three-position toggle switches with spring return to center neutral. Directional torque of the light bulb 62 within its socket and the location of piston head 60 within the piston chamber 38 is controlled by a configuration of two trip switches, resisters and diodes, such combination shown as exemplary only in FIG. 3.

As will be appreciated by those skilled in the art, many minor modifications and changes can be made in the apparatus of the present invention, without departing from the teachings of the present invention.

The embodiment described herein is therefore to be considered as illustrative and not restrictive.

I claim:

1. An apparatus for inserting and extracting light bulbs comprising:

a handle means;

a support means attached to said handle means substantially perpendicularly thereto;

a housing means attached to said support means opposite said handle means and adapted for adjustable rotation about said support means;

a piston housing means secured to said housing means and adapted for a rotational movement independently from said housing means;

a gripping means attached to said piston housing means for gripping a light bulb;

said piston housing means housing a piston means adapted for an axial movement within said housing means for creating a vacuum between said gripping means and a light bulb to be gripped.

2. The apparatus of claim 1, further comprising an electrical motor means for providing a force for imposing rotational movement to the piston housing means.

3. The apparatus of claim 1, wherein an electrical motor means is provided within said housing means for transmitting rotational movement to said piston housing means and an axial movement to the piston means positioned within said piston housing means, said piston means being adapted to facilitate creation of a gripping action of a light bulb by said gripping means.

4. The apparatus of claim 3, wherein said motor means comprise a first motor having an output shaft fixedly attached to a coaxially aligned screw means which passes through an internally threaded nut fixedly attached to a second motor means adapted for a limited axial movement within said housing means.

5. The apparatus of claim 4, wherein said second motor means has an outward shaft fixedly attached to said piston means for transmitting axial movement to said piston means.

6. The apparatus of claim 3, wherein said piston means comprises a piston body and a piston head which frictionally engages an inner wall of the piston housing means for creating a partial vacuum between a light bulb gripped by said gripping means and interior of said piston housing means.

7. The apparatus of claim 1, wherein said support means is provided with a semi-circular groove and said housing is provided with an opening, the opening and the groove, when aligned, adapted for receiving a screw therein, with a head of the screw extending outwardly from said housing means so as to allow limited rotational movement of the housing means in relation to said support means.

8. The apparatus of claim 1, further comprising means for securing said housing means at an angular relationship to said support means.

9. The apparatus of claim 1, wherein said gripping means comprises a piston means adapted for axial movement within said piston housing means and a suction cup fixedly attached to said piston housing means at one end thereof, movement of said piston means away from said suction cup creating a partial vacuum to allow gripping of the light bulb by the suction cup.

10. An apparatus for inserting and extracting light bulbs, comprising:

a handle means, said handle means housing means for transmitting an operational power;

a support means connected to said handle means;

a housing means securedly attached to said support means opposite said handle means and adapted for adjustable rotational movement about the support means, rotation of the housing means allowing manipulation of a light bulb at an angled position;

a piston housing means secured to said housing means and adapted for a rotational movement independently from said housing means;

gripping means attached to said piston housing means for gripping a light bulb, said gripping means comprising a piston means adapted for axial movement within said piston housing means and a suction cup fixedly attached to one end of said piston housing means, axial movement of said piston means away from said suction cup creating a partial vacuum to allow gripping of the light bulb by the suction cup;

an electrical motor means mounted within said housing means, said motor means comprising a first motor for transmitting rotational movement to said piston housing means and a second motor for transmitting a longitudinal axial movement to said piston means within said piston housing means, said first and second motor being operationally connected to the electrical power source.

11. An apparatus for inserting and extracting light bulbs, comprising:

a handle means;

a support means attached to said handle means substantially perpendicularly thereto;

a housing means attached to said support means opposite said handle means and adapted for adjustable rotation about said support means;

a piston housing means secured to said housing means and adapted for a rotational movement independently from said housing means;

a gripping means attached to said piston housing means for gripping a light bulb;

said piston housing means housing a piston means adapted for axial movement within said piston housing means for creating a vacuum between said gripping means and a light bulb to be gripped; an electrical motor means mounted within said housing means for transmitting rotational movement to said piston housing means and an axial movement to the piston means within said piston housing means.

12. The apparatus of claim 11, wherein said motor means comprise a first motor having an outward shaft fixedly attached to a co-axially aligned screw means which passes through an internally threaded nut fixedly attached to a second motor means adapted for a limited axial movement within said housing means.

13. The apparatus of claim 12, wherein said second motor means has an outward shaft fixedly attached to the piston means for transmitting axial movement to said piston means through its connection to the screw means.

14. The apparatus of claim 11, wherein said piston means comprises a piston body and a piston head which frictionally engages an inner wall of the piston housing means for creating a partial vacuum between the light bulb gripped by said gripping means and an interior of said piston housing means.

* * * * *